US008121496B2

(12) United States Patent
Matsuzaki

(10) Patent No.: US 8,121,496 B2
(45) Date of Patent: Feb. 21, 2012

(54) IMAGE FORMING APPARATUS OPERATING IN A POWER SAVING MODE AS LONG AS POSSIBLE

(75) Inventor: Yoshiki Matsuzaki, Fukushima-Ken (JP)

(73) Assignee: Oki Data Corporation, Tokyo (JP)

( * ) Notice: Subject to any disclaimer, the term of this patent is extended or adjusted under 35 U.S.C. 154(b) by 303 days.

(21) Appl. No.: 11/984,968

(22) Filed: Nov. 26, 2007

(65) Prior Publication Data

US 2008/0079982 A1 Apr. 3, 2008

Related U.S. Application Data

(62) Division of application No. 11/157,969, filed on Jun. 22, 2005, now Pat. No. 7,317,879.

(30) Foreign Application Priority Data

Jun. 29, 2004 (JP) ..... 2004-191049

(51) Int. Cl.
*G03G 15/00* (2006.01)

(52) U.S. Cl. ..... 399/9; 399/43; 399/70

(58) Field of Classification Search ..... 399/9, 43, 399/67, 69, 70, 83, 85
See application file for complete search history.

(56) References Cited

U.S. PATENT DOCUMENTS

| | | | | |
|---|---|---|---|---|
| 4,745,436 | A * | 5/1988 | Matsuura | 399/70 |
| 5,881,335 | A | 3/1999 | Yang et al. | |
| 6,438,334 | B1 | 8/2002 | Honma et al. | |
| 2004/0160620 | A1 * | 8/2004 | Ikegami et al. | |
| 2005/0158063 | A1 * | 7/2005 | Mizuno | 399/70 |

FOREIGN PATENT DOCUMENTS

| | | | |
|---|---|---|---|
| JP | 63-014540 | A | 1/1988 |
| JP | 02-129658 | | 5/1990 |
| JP | 08-324071 | A | 12/1996 |
| JP | 2000-190596 | A | 7/2000 |
| JP | 2000-330426 | A | 11/2000 |
| JP | 2001-071587 | A | 3/2001 |
| JP | 2001-282398 | A | 10/2001 |
| JP | 2003-229983 | A | 8/2003 |
| JP | 2003-291460 | A | 10/2003 |
| JP | 2003-314727 | A | 11/2003 |
| JP | 2004-166257 | A | 6/2004 |

* cited by examiner

*Primary Examiner* — David Gray
*Assistant Examiner* — Laura Roth
(74) *Attorney, Agent, or Firm* — Rabin & Berdo, P.C.

(57) ABSTRACT

An image forming apparatus operates in a power saving mode or in the normal printing mode. An image forming section forms an image in accordance with print data received from an external apparatus. A state detecting section detects a state of the image forming apparatus. A controller causes the image forming apparatus to enter into a power saving mode where the controller terminates supply of electric power to a section of the image forming apparatus that consumes a large electric power. A data detecting section detects whether the print data exists in the image forming apparatus. When the state detecting section detects a change in the state of the image forming apparatus and the data detecting section fails to detect print data in the image forming section, the controller causes the image forming apparatus to enter the power saving mode.

11 Claims, 5 Drawing Sheets

IMAGE FORMING APPARATUS OPERATING IN A POWER SAVING MODE AS LONG AS POSSIBLE

This application is a Divisional of U.S. application Ser. No. 11/157,969, filed on Jun. 22, 2005, the subject matter of which is incorporated herein by reference.

BACKGROUND OF THE INVENTION

1. Field of the Invention

The present invention relates to an electrophotographic image forming apparatus, and more particularly to a configuration and a method in which the state of the apparatus is detected and controlled to maintain the apparatus as long a time in a power saving mode as possible to save energy.

2. Description of the Related Art

Among conventional image forming apparatuses such as printers are those equipped with a power saving function. One such apparatus includes a timer and is designed to operate in a power saving mode. A power saving mode is such that if no print job is received for a certain length of time after a print operation is over or the apparatus enters a standby state after a printing operation, a power supply is controlled not to supply high voltage to a fixing unit, drum, belt, operation panel, and LCD or other sections that consume a large power.

In order to shift from the power saving mode back to a print mode, supply of electric power needs to be resumed for preparing a printing operation. Specifically, the temperature of the fixing unit needs to be increased to a normal fixing temperature. The photoconductive drum and transfer belt need to be rotated for cleaning. The operation panel and the display panel such as LCD are again back lit for checking various operations of the apparatus. It takes about a few minutes for a heat roller of the fixing unit to reach the normal fixing temperature.

The apparatus is switched from the power saving mode to the normal printing mode: (1) when the image forming apparatus receives print data from an external apparatus, (2) when a field service engineer closes a cover of the apparatus after repair work, replacement of parts, and (3) when a user closes the cover after replenishment of consumable items or maintenance work.

When the electrophotographic image forming apparatus is turned on, initialization of the apparatus is performed to automatically set up for printing. That is, electric power is supplied to respective sections that require high voltages and high electric power, even though printing is not to be performed immediately after power up.

Some image forming apparatuses incorporate a timer, so that the apparatus is programmed to operate in the power saving mode during a time frame, for example, before normal business hours and lunch time, and after normal business hours in which the apparatus is not used or is used less frequently. Power consumption of the image forming apparatus is thus minimized.

However, it is quite often that in common offices, maintenance work such as replacement of the photoconductive drum and belt and replenishment of toner and paper is carried out before normal business hours, during lunch time, or after business hours, thereby preventing the business efficiency from decreasing.

When maintenance operations are carried out, the user or field service engineer opens the cover of the apparatus, carries out the maintenance work, and then closes the cover again. Even though the apparatus was in the power saving mode prior to the maintenance operation, when the cover is closed after the maintenance operation, the apparatus does not return to the power saving mode but the set-up operation for printing is performed. Thus, the apparatus consumes as much electric power as in the normal printing mode until a predetermined time has elapsed before the apparatus enters the power saving mode. Repetition of such maintenance works shortens the lifetime of the fixing unit, drum, and belt.

Likewise, when the apparatus is turned on, the set-up operation is performed for the apparatus to enter the printing mode even though no printing job is available. This increases power consumption and shortens the life of parts of the apparatus.

SUMMARY OF THE INVENTION

The present invention was made in view of the aforementioned drawbacks of the conventional apparatuses.

An object of the invention is to provide an image forming apparatus in which the apparatus does not perform the set-up operation prior to printing upon completion of maintenance so that power consumption of the apparatus is minimized and the life of parts is prolonged.

Another object of the invention is to provide an image forming apparatus in which the apparatus does not perform the set-up operation prior to printing upon completion of maintenance, even if the apparatus was in the power saving mode when the maintenance of the apparatus was initiated.

An image forming apparatus operates in a power saving mode or in the normal printing mode. An image forming section forms an image in accordance with print data received from an external apparatus. A state detecting section detects a state of the image forming apparatus. A controller causes the image forming apparatus to enter into a power saving mode where the controller terminates supply of electric power to a section of the image forming apparatus that consumes a large electric power. A data detecting section detects whether the print data exists in the image forming apparatus. When the state detecting section detects a change in the state of the image forming apparatus and the data detecting section fails to detect print data in the image forming section, the controller causes the image forming apparatus to enter the power saving mode.

When the controller detects the change in the state of the image forming apparatus when the image forming apparatus is in the power saving mode and said data detecting section fails to detect print data, said controller controls the image forming apparatus to remain in the power saving mode.

The image forming apparatus includes a receiving section, an editing section, and a printing section. The receiving section holds a first item of data received from the external apparatus. The editing section edits the first item of data into a second item of data. The printing section produces a third item of data from the second item of data. The data detecting section checks for presence or absence of at least one of the first item of data, the second item of data, and the third item of data.

The controller may include a memory that holds information indicating that the image forming apparatus is in the power saving mode.

The state detecting section detects opening and closing of a member that is operated to open and close when maintenance of the image forming apparatus is performed.

The state detecting section detects whether an operation panel of the image forming apparatus has been operated.

The state detecting section detects when a print medium tray has been mounted to the image forming apparatus and when a print medium tray has been dismounted from the image forming apparatus.

The state detecting section detects whether the print medium tray holds print medium therein.

The state detecting section detects whether data received in the image forming apparatus is to be opened by an addressee only.

The controller controls the image forming apparatus to move out of the power saving mode and performs a setup operation prior to printing.

An image forming apparatus includes a receiving section, an image forming section, a controller, and a data detecting section. The receiving section receives print data from an external apparatus. The image forming section forms an image in accordance with the print data received from the external apparatus. The controller causes the image forming apparatus to enter a power saving mode where said controller terminates supply of electric power to a predetermined section of the image forming apparatus. The data detecting section detects whether the print data exists in the image forming apparatus. When the image forming apparatus is turned on, if said data detecting section fails to detect the print data, said controller controls the image forming apparatus to enter the power saving mode.

When the receiving section is ready to receive data from the external apparatus, said data detecting section initiates to detect whether print data exists in the image forming apparatus.

The controller controls the image forming apparatus to shift from a power saving mode and performs a setup operation prior to printing.

The image forming apparatus may further include a receiving section, an editing section, and a printing section. The receiving section holds a first item of data received from the external apparatus. The editing section edits the first item of data into a second item of data. The printing section produces a third item of data from the second item of data. The data detecting section checks for presence or absence of at least one of the first item of data, the second item of data, and the third item of data.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DESCRIPTION OF THE INVENTION

Preferred embodiments will be described with reference to the accompanying drawings.

First Embodiment

{Construction}

Figure 1:
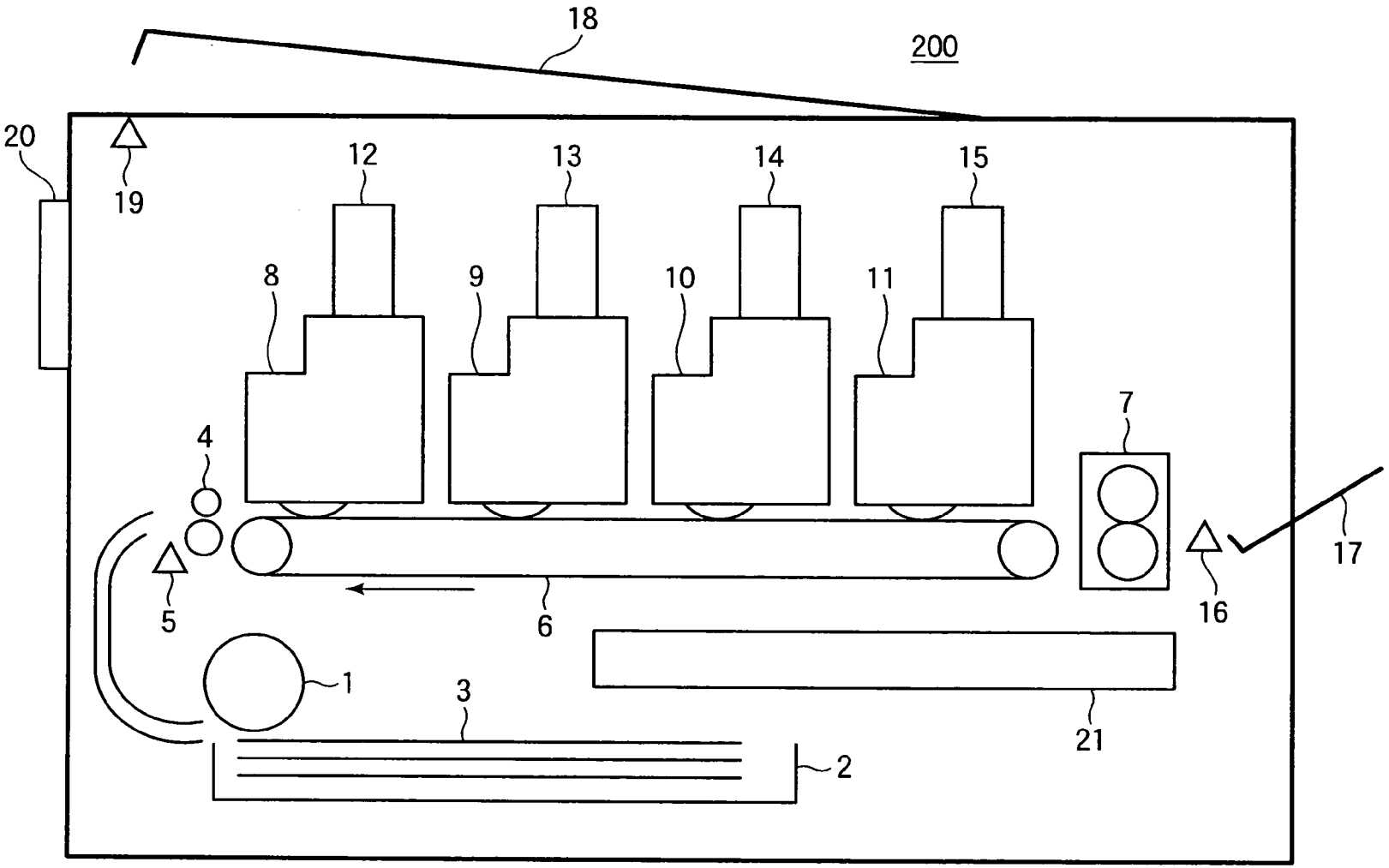
FIG. 1 illustrates the configuration of an image forming apparatus according to the invention.

FIG. 1 illustrates the configuration of an image forming apparatus according to the invention. A hopping roller 1 feeds a recording medium 3 from a paper tray 2 to image forming sections or drum units 8-11. The drum units 8-11 form black, cyan, magenta, and yellow images, respectively. The paper tray 2 holds a stack of recording medium 3 therein. A feed roller 4 and a belt 6 cooperate with each other to transport the recording medium 3. A medium sensor 5 monitors the passage of the recording medium 3 that is fed to the drum units 8-11. A fixing unit 7 applies heat and pressure to an image formed on the recording medium 3, thereby fixing the image on the recording medium 3 into a permanent image. Toner cartridges 12-15 hold toners of corresponding colors, and are attached to the corresponding drum units 8-11. A discharge sensor 16 monitors the recording medium 3 that is discharged from the image forming apparatus onto a stacker 17. A lid sensor 19 monitors the opening and closing of a cover 18 of the image forming apparatus. A user inputs various data into the image forming apparatus through an operation panel 20, which in turn displays the operating states of the image forming apparatus. A controller 21 holds control programs for controlling the various operations of the image forming apparatus, and controls the operations of the image forming apparatus in accordance with the control programs.

{Data Processing and Overall Control}

Figure 2:
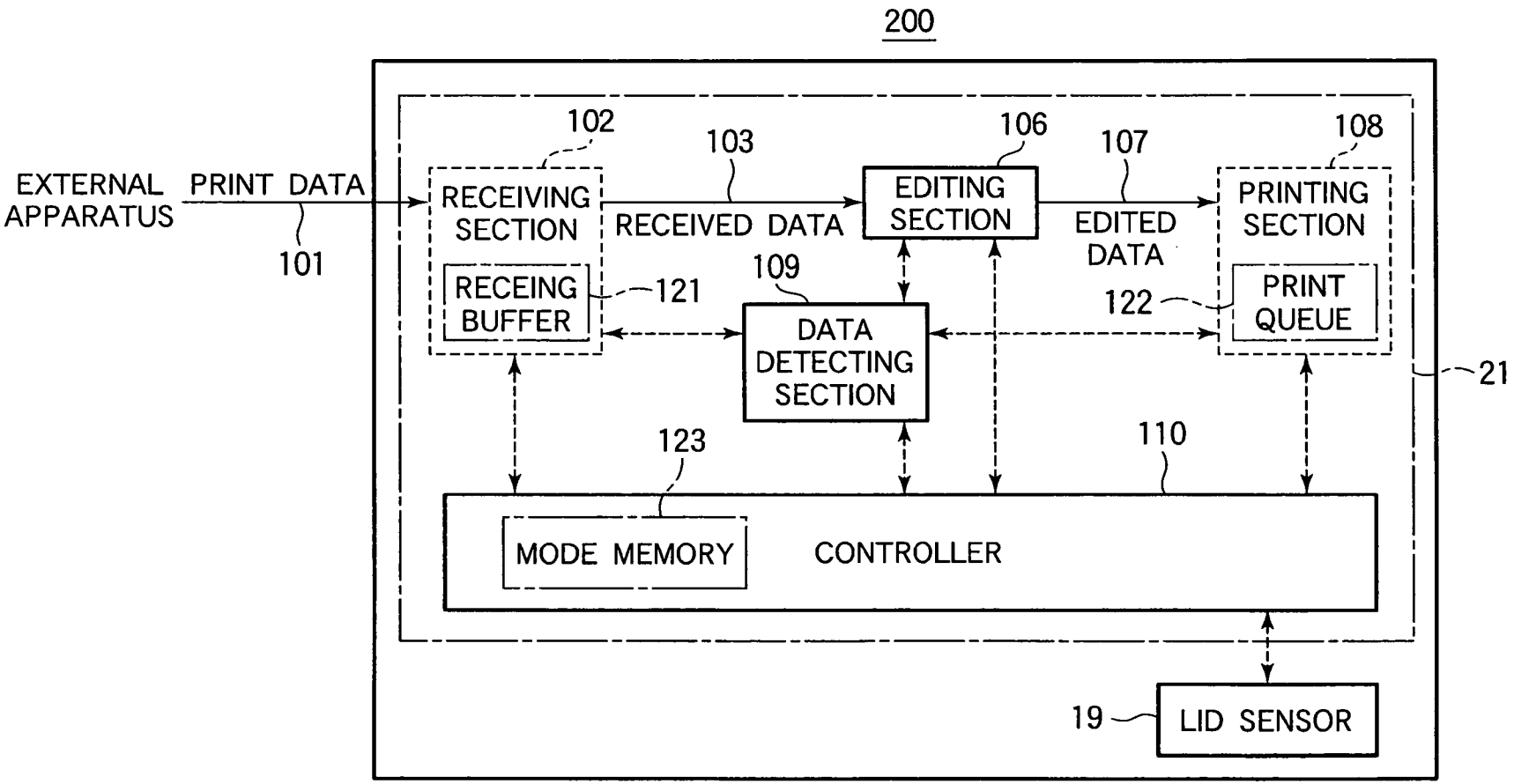
FIG. 2 is a block diagram illustrating the data processing and overall control of the image forming apparatus in FIG. 1.

FIG. 2 is a block diagram illustrating the data processing and overall control of the image forming apparatus 200 in FIG. 1.

The operation of the image forming apparatus for processing data and controlling the respective sections will be described with reference to FIG. 2.

A receiving section 102 receives print data 101 from an external apparatus and temporarily stores the print data 101 in a receiving buffer 121. An editing section 106 obtains the received data 103 from the receiving section 102, and edits the received data 103 into a data format that can be printed. A print queue 122 stores the edited data 107 that was edited in the editing section 106. A printing section 108 extracts the edited data 107 from the print queue 122 and prints the edited data 107. A data detecting section 109 detects whether print data exists in the image forming apparatus. A lid detecting section 111 (FIG. 3) monitors the output of the lid sensor 19 to detect the opening and closing of the lid 18 of the image forming apparatus.

The menu displayed on the operation panel 20 includes, for example, the ON/OFF state of a power saving mode (which will be described later) and the time length that should be allowed before the image forming apparatus enters the power saving mode (e.g., 0, 5, 60, and 120 minutes).

When the user sets the power saving mode to "OFF" from the operation panel 20, the image forming apparatus will not shift to the power saving mode but stay in the normal printing mode.

{Image Forming Operation}

The image-forming operation will be described.

The hopping roller 1 rotates to feed the recording medium 3 in the paper tray 2 to the feeding rollers 4. The feeding rollers 4 rotate to further advance the recording medium 3 to the belt 6, which in turn transports the recording medium 3 through the image drum units 8-11 to the fixing unit 7. The drum units 8-11 form images of corresponding colors and transfer the images onto the recording medium 3 one over the other. The fixing unit 7 applies heat and pressure to the images formed on the recording medium 3 to fix the images into a permanent image. The recording medium 3 is then discharged onto the stacker 17. The medium sensor 5 and discharge sensor 16 monitor the recording medium 3 that passes by the medium sensor 5 and discharge sensor 16. When the medium sensor 5 and discharge sensor 16 detect an occurrence of a paper jam, the medium sensor 5 and discharge sensor 16 notify the controller 21 of the paper jam. Upon detecting an abnormality, the controller 21 stops printing, causes the operation panel 20 to display the detected abnormality, and prompts the user to remove the abnormality. When a paper jam is removed, the user opens the lid 18, then removes the jammed paper, and finally closes the lid 18. The lid sensor 19 detects whether the lid 18 is opened or closed, and notifies the controller 21 of the state of the lid 18. The lid 18 is also opened and closed when toner cartridges 12-15 are replaced upon exhaustion or when the drum units 8-11 are replaced at the end of their lifetime.

With reference to FIG. 2, a description will be given of the data processing and control operation from when print data is received until the image is formed in the image forming apparatus.

D1: The receiving section 102 receives the print data 101 from an external apparatus.

D2: The receiving buffer 121 resides in the receiving section 102 and stores the received data 101.

D3: The editing section 106 extracts the received data 103 from the receiving buffer 121, and edits the received data 103 into an intermediate format.

D4: The printing section 108 processes the edited data 107 received from the editing section 106 to produce data in bit map form (an intermediate format).

D5: The print queue 122 resides in the printing section 108, and holds the edited print data until the preceding print data has been printed out or until a setup operation prior to printing completes.

D6: The data detecting section 109 sends to the receiving section 102, editing section 106, and printing section 108 a request to check whether print data exists in the respective sections (102, 106, and 108), and stores replies from the respective sections. Based on the replies, the data detecting section 109 determines whether the print data to be printed exists in the image forming apparatus.

D7: The controller 110 monitors the operations of the receiving section 102, editing section 106, and printing section 108 to ensure a smooth operation from receiving of print data until printing of print data. If an abnormality occurs in the image forming apparatus, the controller 110 causes the receiving section 102, editing section 106, and printing section 108 to stop their operations. The controller 110 checks the receiving section 102, editing section 106, and printing section 108 at all times to determine whether there is print data left in them. Then, the controller 110 shifts the image forming apparatus to the power saving mode a certain length of time after print data becomes unavailable, or shifts to the printing mode upon receiving print data.

D8: A mode memory 123 holds information on whether the image forming apparatus was in the power saving mode or the normal printing mode immediately before an abnormality occurred or a maintenance operation was initiated.

D9: The lid detecting section 111 detects the opening and closing of the lid 18 in terms of the output of the lid sensor 19.

Figure 3:
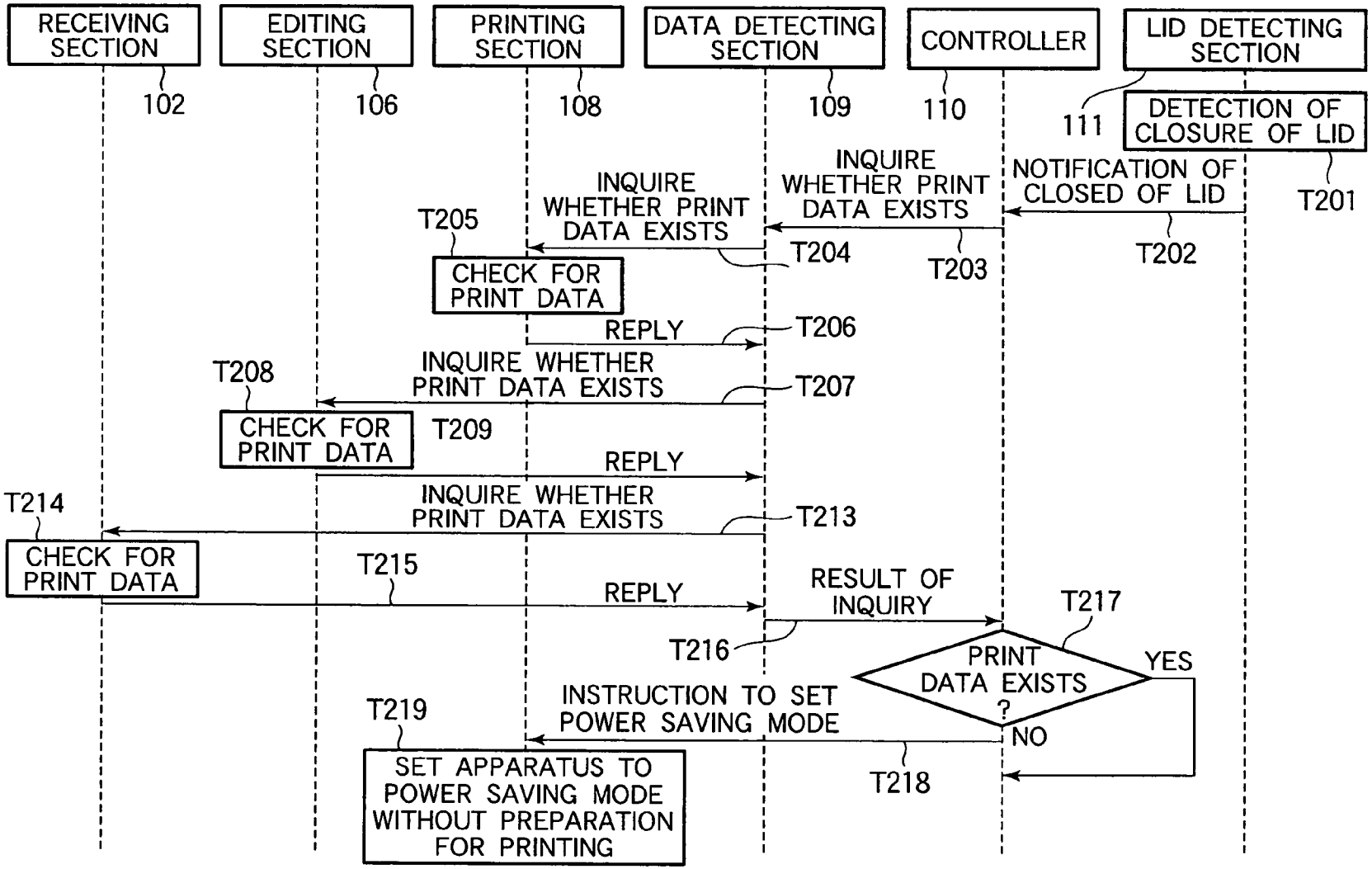
FIG. 3 is a task flowchart of the image forming apparatus according to the first embodiment.

FIG. 3 is a task flowchart of the image forming apparatus according to the first embodiment. The procedural steps for setting the image forming apparatus to the power saving mode will be described with reference to FIGS. 1-3.

Assume that the image forming apparatus is in the power saving mode and that the drum unit 8 of the image forming apparatus has reached the end of its usable life.

The lifetime of a drum unit may be detected in terms of an accumulated amount of time since the drum unit was replaced last time, or an accumulated number of printed pages. When the drum unit 8 reaches the end of its lifetime, the operation panel 20 will display a message that prompts the user to replace the drum unit 8. The user is notified that the drum unit 8 has reached the end of its lifetime. However, this notification does not mean that the drum unit 8 should be replaced immediately. Thus, the drum unit 8 may be replaced at a time when print requests are received less frequently, for example, prior to business hours, at lunchtime, or after business hours. The drum unit 8 may also be replaced upon arrival of a previously ordered new, unused drum unit.

When the image forming apparatus is in the power saving mode, the mode memory 123 in the controller 110 is set to a value of "1". When the image forming apparatus is in the normal printing mode, the mode memory 123 is set to a value of "0". These values are set appropriately when the image forming apparatus is shifted from one mode to another. The value in the mode memory 123 may be displayed on the operation panel 20 so as to notify the user.

T201: When the user replaces the drum unit 8, the user opens the lid 18, replaces the old drum unit by a new, unused drum unit, and finally closes the lid 18. Because the lid detecting section 111 monitors the lid sensor 19 at all times, the lid detecting section 111 detects when the lid 18 is closed.

T202: The lid detecting section 111 notifies the controller 110 of the closing of the lid 18.

T203: When the controller 110 receives a notification from the lid detecting section 111, if the mode memory 123 holds a value of "1," the controller 110 inquires the data detecting section 109 as to whether print data exists in the image forming apparatus. If the mode memory 123 holds a value of "0," the controller 110 initiates a setup operation prior to printing. Even if the mode memory 123 holds the value of "0," the controller 110 may check the presence and absence of print data, thereby saving electric power even further.

T204: The data detecting section 109 first inquires the printing section 108 as to whether print data exists.

T205: The printing section 108 makes a determination as to whether the print data exists in the print queue 122. If the print data exists, the printing section 108 determines that print data exists in the printing section 108.

T206: The printing section 108 sends a reply indicative of existence or non-existence of print data to the data detecting section 109.

T207: Then, the data detecting section 109 inquires the editing section 106 as to whether print data exists.

T208: The editing section 106 checks whether print data is currently being edited. If print data exists, the editing section 106 determines that print data is currently being edited.

T209: Then, the editing section 106 sends a reply indicative of the result of inquiry to the data detecting section 109.

T213: The data detecting section 109 inquires the receiving section 102 of whether data to be printed exists.

T214: If the print data to be printed exists in the receiving buffer 121, the receiving section 102 determines that the print data exists.

T215: Thus, the receiving section 102 sends a reply indicative of the result of inquiry to the data detecting section 109.

In addition to the print data, the receiving section 102 receives an item of information that indicates the type of data, i.e., whether the data is print data or a status inquiry. Print data is an item of data that involves the forming, transferring, and fixing of an image. Edited data is print data. If the status inquiry is received, no setup operation prior to printing is necessary. The data detecting section 109 may send a reply indicative of "NON PRINT DATA" to the receiving section 102 if the type of received data is known.

T216: The data detecting section 109 checks the result of inquiry to determine whether print data exists in the image forming apparatus. If at least one of the receiving section 102, editing section 106, and printing section 108 holds print data, the data detecting section 109 determines that print data exists in the image forming apparatus. Then, the data detecting section 109 sends a reply to the controller 110.

T217: Based on the result of inquiry, the controller 110 performs the following operations.

T218: If the reply is "PRINT DATA ABSENT", then the controller 110 sends to the printing section 108 an instruction to enter the power saving mode. If the reply is "PRINT DATA PRESENT," the controller 110 sends to the printing section 108 an instruction to perform the setup operation prior to printing.

T219: Upon receiving a request-to-enter-power saving mode, the printing section 108 enters the power saving mode.

A maintenance work involves opening and closing of the lid 18. As described above, when the maintenance work is performed, the data detecting section 109 does not immediately prepare for printing but determines whether print data exists and checks a power-supplying mode (i.e., power saving mode or normal printing mode) where the image forming apparatus was immediately before the maintenance work. If there is no print data and the image forming apparatus was in the power saving mode before the maintenance work, then the printing section 108 does not perform the setup operation prior to printing but enters the power saving mode. This minimizes power consumption of the image forming apparatus and prolongs the life of parts of the image forming apparatus.

The image forming apparatus may be configured such that a determination is made as to whether print data exists in the image forming apparatus, not only when the aforementioned maintenance work is performed but also when a panel switch is pressed, when the paper tray is pulled out of and inserted into the image forming apparatus, and when an original to be read is placed in position. Further, if the image forming apparatus takes the form of, for example, a facsimile machine, the image forming apparatus may be configured to remain in the power saving mode when the incoming data is to be opened by an addressee only.

Second Embodiment

In common offices, a printer type image forming apparatus is connected to many personal computers so that the printer is shared with many users. Such a printer apparatus is connected to the users over a network. It is common that the printer apparatus is turned on at the beginning of each day's work and remains turned on until the last person leaves the office.

With such a printer type image forming apparatus, the setup operation prior to printing is performed shortly after power-up but no printing is actually performed and the apparatus enters a power saving mode after a predetermined length of time. Then, upon receiving print data, the setup operation prior to printing is performed before shifting from the power saving mode to the normal printing mode.

If the apparatus is not used very frequently, it is wasteful to perform the setup operation prior to printing shortly after power-up. This leads to waste of electric power and shortens the usable life of components of the image forming apparatus. A second embodiment provides an image forming apparatus that is configured and is operated to solve the aforementioned problem.

The configuration of the image forming apparatus is the same as the first embodiment and therefore only a different portion will be described.

Figure 4:
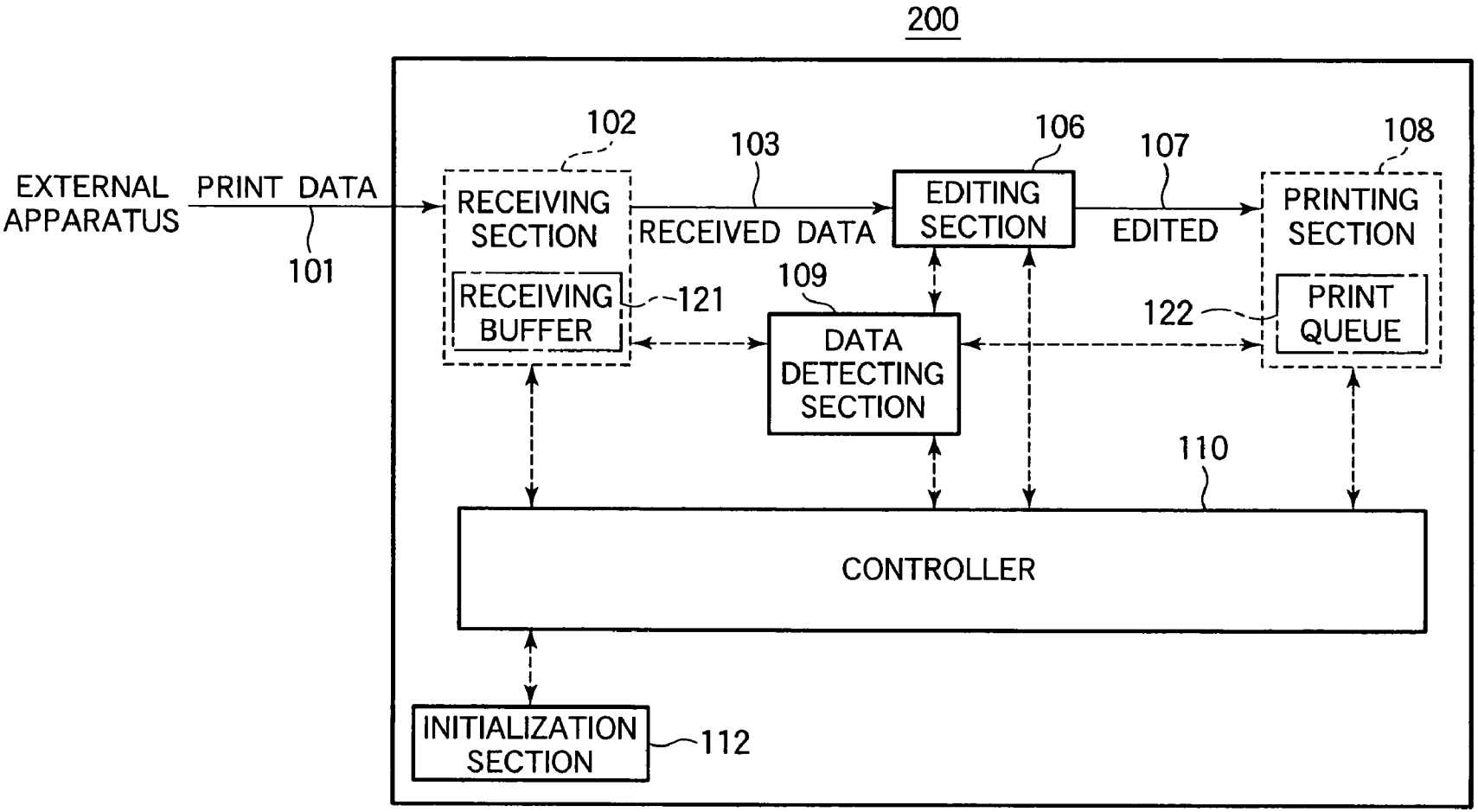
FIG. 4 is a block diagram illustrating the data processing and controls for an image forming apparatus according to the second embodiment.

FIG. 4 is a block diagram illustrating the data processing and controls for an image forming apparatus (FIG. 1) according to the second embodiment.

With reference to FIG. 4, a description will be given of the data processing and controls for an image forming apparatus from when print data is received until image formation. The second embodiment is the same as the first embodiment in the operation from reception of print data 101 until the print engine 108 prints the print data.

D1: The receiving section 102 receives the print data 101 from an external apparatus.

D2: The receiving buffer 121 resides in the receiving section 102, and stores the received data.

D3: The editing section 106 extracts the received data 103 from the receiving buffer 121, edits the received data 103 into an intermediate format, and prints the data.

D4: The printing section 108 processes the edited data 107 received from the editing section 106 to produce data in bit map form (intermediate format).

D5: The print queue 122 resides in the print engine 108 and holds the print data until the preceding print data has been printed out or until a setup operation prior to printing completes.

D6: The data detecting section 109 sends to the respective sections a request to check whether print data exists in the respective sections, and stores replies from the receiving section 102, editing section 106, and printing section 108. Based on the replies, the data detecting section 109 determines whether the print data exists in the image forming apparatus.

D7: The controller 110 monitors the operation of the receiving section 102, editing section 106, and printing section 108 to maintain a smooth operation from receiving of print data until printing of print data. If an abnormality occurs in the image forming apparatus, the controller 110 causes the receiving section 102, editing section 106, and printing section 108 to stop their operations. The controller 110 also monitors the operation of the printing section 108 and the status of the receiving section 102, editing section 106, and printing section 108 as to whether they have print data left. The controller 110 shifts the image forming apparatus to the power saving mode a certain length of time after print data becomes unavailable or shifting to the printing mode upon receiving print data. The second embodiment does not use the mode memory 123 and the lid detecting section 111 in FIG. 2, and therefore operations denoted at D8 and D9 in FIG. 2 are not performed.

D10: Shortly after the image forming apparatus is turned on, an initialization section 112 is activated before other sections are activated and checks storage means such as a RAM and a ROM, not shown, in the image forming apparatus. Then, the respective sections including the controller 110 and receiving section 102 are activated and initialized. The rest of the configuration is the same as that of the first embodiment.

Figure 5:
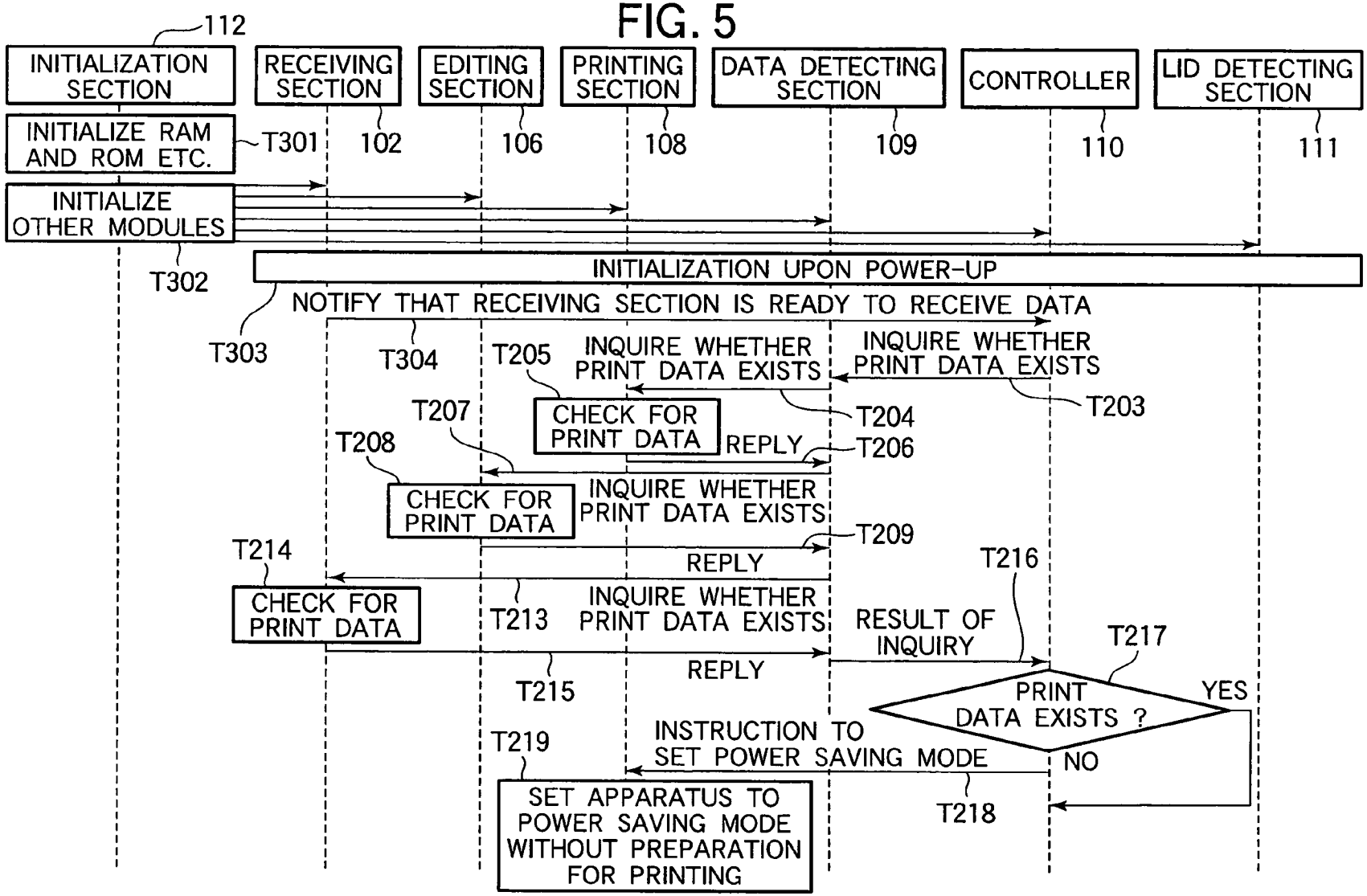
FIG. 5 illustrates a task flow for an image forming apparatus in FIG. 1 and FIG. 4.

FIG. 5 illustrates a task flow for an image forming apparatus in FIG. 1 and FIG. 4.

The procedure for setting the image forming apparatus to the power saving mode will be described with reference to FIGS. 1, 4, and 5.

T301: Upon power-up of the image forming apparatus, the initialization section 112 begins to operate. The initialization section 112 performs initialization for checking, for example, the ROM and RAM in the image forming apparatus, so that the entire system can operate properly.

T302: Other modules such as the receiving section 102 are activated and initialized.

T303: Initialization is performed in the receiving section 102, receiving buffer 121, editing section 106, printing section 108, data detecting section 109, controller 110, and initialization section 112.

T304: When the initialization has been completed so that the image forming apparatus is ready to receive print data and other signals, the receiving section 102 notifies the controller 110 that the receiving section 102 is ready to receive print data and other signals.

T203: When the controller 110 receives the notification from the receiving section 102, the controller 110 inquires the data detecting section 109 as to whether print data exists in the image forming apparatus.

T204: The data detecting section 109 first inquires the printing section 108 as to whether print data exists.

T205: The printing section 108 makes a determination as to whether the print data exists in the print queue 122. If the print data exists in the queue 122, the printing section 108 determines that print data exists.

T206: The printing section 108 sends a reply indicative of existence or non-existence of print data to the data detecting section 109.

T207: Then, the data detecting section 109 inquires the editing section 106 as to whether print data exists.

T208: The editing section 106 checks the editing section 106 to determine whether print data is currently being edited. If print data exists, the editing section 106 determines that print data is currently being edited.

T209: The editing section 106 sends a reply indicative of the result of inquiry to the data detecting section 109.

T213: The data detecting section 109 inquires the receiving section 102 as to whether print data exists.

T214: If the print data exists in the receiving buffer 121, the receiving section 102 determines that the print data exists.

T215: Thus, the receiving section 102 sends a reply indicative of the result of inquiry to the data detecting section 109.

When the image forming apparatus is turned on, there may be no print data in the editing section 106 and printing section 108, in which case, the data detecting section 109 inquires only the receiving section 102 as to whether print data to be printed exits.

T216: The data detecting section 109 checks the result of inquiry to determine whether print data exists in the receiving section 102, editing section 106, and printing section 108. If at least one of the receiving section 102, editing section 106, and printing section 108 holds print data, the data detecting section 109 determines that print data exists in the image forming apparatus. Then, the data detecting section 109 sends a reply to the controller 110.

T217: Based on the result of inquiry, the controller 110 performs the following operations.

T218: If the result of inquiry is "NO PRINT DATA", then the controller 110 sends to the print engine 108 an instruction to enter the power saving mode. If the result of inquiry is "PRINT DATA EXISTS," the controller 110 sends to the print engine 108 an instruction to perform the setup operation prior to printing.

T219: Upon receiving a request-to-enter-power saving mode from the controller 110, the printing section 108 enters the power saving mode. Thus, in the second embodiment, if there is no print data shortly after power up of the image forming apparatus, the setup operation prior to printing is not performed. Thereafter, the setup operation prior to printing is performed upon receiving print data.

As described above, a setup operation prior to printing is not performed automatically after power up of the image forming apparatus, but a check is made to determine whether print data exists in the image forming apparatus. If there is no print data, the image forming apparatus directly enters the power saving mode without performing the setup operation prior to printing. This eliminates unnecessary power consumption and prolongs the life of components.

While the first and second embodiments have been described separately, the two embodiments may be combined in a single image forming apparatus.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus comprising:

an image forming section that forms an image in accordance with print data received from an external apparatus;

a state detecting section that detects a state of the image forming apparatus;

a controller that selectively causes the image forming apparatus to enter into a power saving mode where said controller limits supply of electric power to a predetermined section of the image forming apparatus or into a normal printing mode where printing is performed normally;

a data detecting section that detects whether data obtained by processing the print data received from an external apparatus exists within the image forming apparatus;

wherein when the image forming apparatus is in the power saving mode, if said data detecting section fails to detect the processed data in the image forming section after said state detecting section has detected a change in the state of the image forming apparatus, said controller maintains the image forming apparatus in the power saving mode; and wherein when the image forming apparatus is in the power saving mode, if said data detecting section detects the processed data in the image forming section after said state detecting section has detected a change in the state of the image forming apparatus, said controller causes the image forming apparatus to enter the normal printing mode, wherein the image forming apparatus further comprises:

a receiving section that holds a first item of data received from the external apparatus; and an editing section that edits the first item of data into a second item of data; and a printing section that produces a third item of data from the second item of data;

wherein said data detecting section checks for presence or absence of at least one of the first item of data, the second item of data, and the third item of data, wherein said data detecting section detects the third item of data, the second item of data, and the first item of data in this order.

2. The image forming apparatus according to claim 1, wherein when said controller detects the change in the state of the image forming apparatus when the image forming apparatus is in the power saving mode and said data detecting section fails to detect the data obtained by processing the print data received from the external apparatus, said controller controls the image forming apparatus to remain in the power saving mode.

3. The image forming apparatus according to claim 1, wherein said controller includes a memory that holds information indicating that the image forming apparatus is in the power saving mode.

4. The image forming apparatus according to claim 1, wherein said state detecting section detects opening and closing of a member that is operated to open and close when maintenance of the image forming apparatus is performed.

5. The image forming apparatus according to claim 1, wherein said state detecting section detects whether an operation panel of the image forming apparatus has been operated.

6. The image forming apparatus according to claim 1, wherein said state detecting section detects when a print medium tray has been mounted to the image forming apparatus and when a print medium tray has been dismounted from the image forming apparatus.

7. The image forming apparatus according to claim 6, wherein said state detecting section detects whether the print medium tray holds print medium therein.

8. The image forming apparatus according to claim 1, wherein said controller controls the image forming apparatus to move out of the power saving mode and performs a setup operation prior to printing.

9. The image forming apparatus according to claim 1, further comprising:

an editing section that edits the received data; and a printing section that prints the edited data, wherein the data obtained by processing the print data received from the external device is held in at least one of the editing section and the printing section.

10. The image forming apparatus according to claim 1, further comprising a lid openable and closable relative to the image forming apparatus, wherein the data obtained by processing the print data received from the external device is data which remains within the image forming apparatus after said state detecting section has detected that the change in the state of the image forming apparatus and before the lid is opened.

11. An image forming apparatus comprising:

an image forming section that forms an image in accordance with print data received from an external apparatus;

a state detecting section that detects a state of the image forming apparatus;

a controller that selectively causes the image forming apparatus to enter into a power saving mode where said controller limits supply of electric power to a predetermined section of the image forming apparatus or into a normal printing mode where printing is performed normally;

a data detecting section that detects whether data obtained by processing the print data received from an external apparatus exists within the image forming apparatus;

wherein when the image forming apparatus is in the power saving mode, if said data detecting section fails to detect the processed data in the image forming section after said state detecting section has detected a change in the state of the image forming apparatus, said controller maintains the image forming apparatus in the power saving mode; and wherein when the image forming apparatus is in the power saving mode, if said data detecting section detects the processed data in the image forming section after said state detecting section has detected a change in the state of the image forming apparatus, said controller causes the image forming apparatus to enter the normal printing mode, wherein said state detecting section detects whether data received in the image forming apparatus is to be opened by an addressee only.

* * * * *